US008038391B2

(12) United States Patent
Ishikawa et al.

(10) Patent No.: US 8,038,391 B2
(45) Date of Patent: Oct. 18, 2011

(54) VORTEX BLOWER

(75) Inventors: Shizu Ishikawa, Chiba (JP); Hiroshi Asabuki, Sakura (JP); Satoshi Takeda, Funabashi (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 806 days.

(21) Appl. No.: 12/131,958

(22) Filed: Jun. 3, 2008

(65) Prior Publication Data

US 2009/0317235 A1 Dec. 24, 2009

(30) Foreign Application Priority Data

Jun. 4, 2007 (JP) ..... 2007-147615

(51) Int. Cl.
*F01D 1/06* (2006.01)

(52) U.S. Cl. ..... 415/206; 415/224

(58) Field of Classification Search ..... 415/206, 415/224

See application file for complete search history.

(56) References Cited

U.S. PATENT DOCUMENTS 3,849,024 A * 11/1974 Masai et al. ..... 415/55.2
3,899,266 A * 8/1975 Masai et al. ..... 415/55.1
4,412,781 A * 11/1983 Abe et al. ..... 415/55.4
5,281,083 A * 1/1994 Ito et al. ..... 415/55.1
5,536,139 A * 7/1996 Yamazaki et al. ..... 415/55.1
2006/0269394 A1* 11/2006 Ishikawa et al. ..... 415/55.1
2007/0196207 A1* 8/2007 Yonehara ..... 415/206

FOREIGN PATENT DOCUMENTS

JP 51-27111 3/1976
JP 03-078595 4/1991
JP 3078595 4/1991
JP 2680136 8/1997
JP 2005207278 A * 8/2005
JP 2007309286 A * 11/2007

OTHER PUBLICATIONS

Chinese Office Action of Appln. No. 2008 10109592.5 dated Feb. 12, 2010 with partial English translation.

* cited by examiner

*Primary Examiner* — George Fourson, III
(74) *Attorney, Agent, or Firm* — Antonelli, Terry, Stout & Kraus, LLP.

(57) ABSTRACT

In the present invention, a partition wall which partitions a discharge port and a suction port provided on a static passage, in the rotating direction, has a discharge side shape which is identical with the shape of blades, and has a positional relationship in which the partition wall does not overlap with the discharge port in view of such a fact that the pressure variation on the suction side is higher than that of the discharge side, and noise on the suction side is dominant.

4 Claims, 7 Drawing Sheets

VORTEX BLOWER

INCORPORATION BY REFERENCE

The present application claims priority from Japanese application JP2007-147615 filed on Jun. 4, 2007, the content of which is hereby incorporated by reference into this application.

BACKGROUND OF THE INVENTION (1) Field of the Invention

The present invention relates to a vortex blower.

(2) Description of the Related Art

A vortex blower has the feature that its pressure coefficient which is a dimensionless value indicating a work load per unit impeller diameter is high in comparison with that of a centrifugal blower, and has been heretofore widely used as a blower having a relatively small capacity. There has been presented an increased demand of miniaturization, high-pressurization, noise reduction and the like for the vortex blower, and accordingly, various proposals have been made for improving the configuration of a partition wall between a suction port and a discharge port, provided on a static passage in order to achieve the above-mentioned demand.

The configuration of the partition wall of the conventional vortex blower has been variously studied in order to enhance the aerodynamic performance and to reduce noise. For example, as disclosed in JP-A-51-27111 or JP-B2-2680136, a vortex blower which reduces noise in view of a correlation between the configuration of blades of an impeller and the configuration of the partition wall.

JP-A-51-27111 discloses a vortex blower having the configuration which aims at reducing noise in the case that the shape of blades of an impeller is linear in the radial direction thereof. That is, the partition wall has a discharge side shape with which a stream is finally shut off at the flow center at which flow variation is minimum. Further, the partition wall have the shape that it gradually partitions a stream, from the inner peripheral side, rather than finally partitioning the stream at a point where the flowing speed on the outer peripheral side is maximum, so as to aim at reducing noise.

The above-mentioned JP-B2-2680136 proposes a vortex blower including an impeller with blades which have a three-dimensionally curved so as to increase the pressure coefficient in order to reduce noise. In this vortex blower, the partition wall is provided with guides which overlap with a suction port and a discharge port on a static passage as viewed in front of the vortex blower, the guide on the suction side having the shape that its front end cuts the blade from the outer peripheral side of the impeller, but is opened to the static flow passage from the inner peripheral side while the guide on the discharge side has the shape that it partitions the blades from the inner peripheral side of the impeller, and as a result, the stream matches the velocity distribution of a vortex-like stream generated between the impeller and the casing, thereby it is possible to reduce noise.

SUMMARY OF THE INVENTION

As to the noise of a vortex blower, frequency components caused by the interference between the blades of the impeller and the partition wall are dominant, the frequency thereof is a multiple of the product of the number of blades of the impeller and the revolution speed. As to the mechanism of sound production, it has been conventionally considered that the pressure interference between the blades and the partition walls causes pressure variation which produces sounds. In order to reduce noise, in the above-mentioned prior art, there has been proposed the method that the pressure variation caused by the blades and the partition wall is decreased.

In addition to the high flow-out velocity on the discharge side of the partition wall, it is consider that the pressure variation becomes larger so as to increase noise if the blades and the partition wall have the configuration that the stream is partitioned from the inner peripheral side to the outer peripheral side at the same side, and accordingly, the partition wall has the shape which partitions the blades, gradually and obliquely and which will be hereinbelow referred to as "skew". On the suction side of the partition wall, it has been proposed that the blades and the partition wall are set to a skew so as to prevent the blades from being partitioned at one time, similar to the discharge side, so as to smoothly guide the inflow air into blade inlets in order to reduce noise.

The partition wall has the function that the leakage flow rate is reduced with the use of the length obtained by partitioning the distance between the blade and the partition wall with a suitable number of the blades while a suitable gap is maintained so as to prevent the increased pressure of the vortex blower. Particularly, as in the method disclosed in the JP-B2-2680136, since the partition wall is curved in the circumferential direction so as to allow the blades to increase the pressure, the length of the partition wall with respect to the partitioning number of blades becomes longer in comparison with the impeller having blades which are linear in the radial direction as disclosed in JP-A-51-27111, and since the partition wall for the impeller is skewed on both suction side and discharge side, the effective static passage becomes shorter.

Meanwhile, although the pressure rise of the vortex blower depends upon a length of the static passage, both suction side and discharge side of the partition wall are formed in the skew shape at the same time, exceeding the length of the partitioning number of the blades, and accordingly, the static passage become shorter, resulting in lowering of pressure. Further, in the technology disclosed in JP-B2-2680136, due to the configuration that the suction port and the discharge port are overlapped with the partition guides, no smooth flow is induced on the discharge side, and occurrence of loss would be possible.

The present invention is devised in view of the above-mentioned problems, and accordingly, an object of the present invention is to provide a vortex blower having a high pressure without increasing noise.

To the end, according to an aspect of the present invention, there is provided a vortex blower having a rotary shaft, in combination of a blade casing having an annular groove around the rotary shaft as a center, an impeller incorporating a plurality of blades crossing the annular blade, for sectioning the annular groove of the blade casing in the circumferential direction, within the annular groove, and a casing formed therein with a static passage opposed to the annular groove, characterized in that a partition wall for partitioning between a suction port and a discharge port which are provided on the static passage, in the rotating direction has a discharge side shape which is identical with the shape of the blades.

With the above-mentioned configuration, the following is preferable embodiments:

(1) having the positional relationship that the partition wall is prevented from being overlapped with the discharge port provided on the static passage; and (2) The blade shape of the impeller is curved as viewed from the rotary shaft.

According to the present invention, there may be provided a vortex blower having a high pressure without increasing noise.

BRIEF DESCRIPTION OF THE DRAWINGS

These and other features, objects and advantages of the present invention will become more apparent from the following description when taken in conjunction with the accompanying drawings wherein:

FIG. 3 shows a conventional vortex blower, in which

DETAILED DESCRIPTION OF THE PREFERRED EMBODIMENTS

While we have shown and described several embodiments in accordance with our invention, it should understood that disclosed embodiments are susceptible of changes and modifications without departing from the scope of the invention. Therefore, we do not intend to be bound by the details shown and described herein but intend to cover all such changes and modifications and fall within the ambit of the appended claims.

Figure 1:
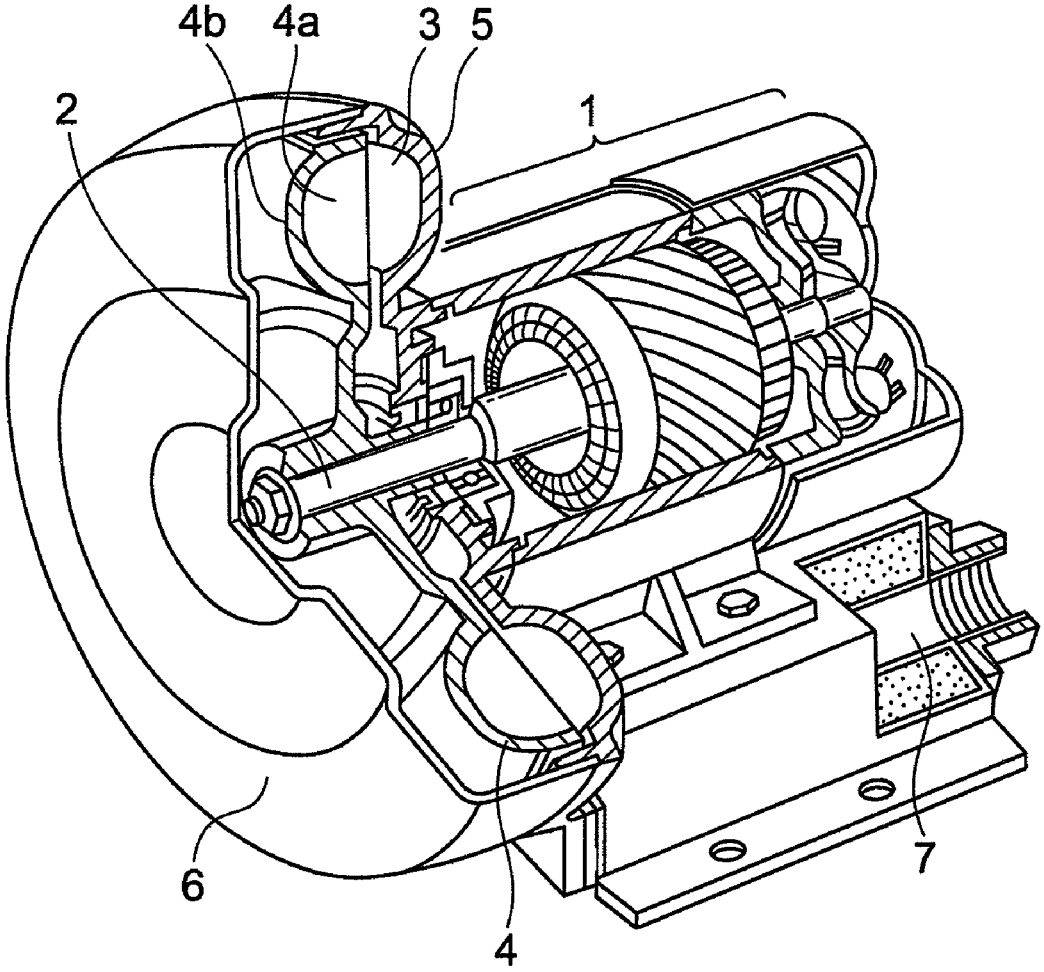
FIG. 1 is a view illustrating the configuration of a vortex blower in an embodiment of the present invention.

Referring to FIG. 1 which is a view illustrating a configuration of a vortex blower in an embodiment, the vortex blower comprises an induction motor 1, a rotary shaft 2 of the induction motor, a static passage 3 in a casing, an impeller 4 of the vortex blower, blades 4*a* of the impeller, a blade casing 4*b* for the impeller. FIG. 1 also shows a casing defining therein the static passage 3, a side cover 6 of the vortex blower, and a sound absorber 7 formed therein with a passage communicated with the suction port. Thus, the suction port and the discharge port for externally outputting a flow rate from the vortex chamber are arranged in one and the same direction, and a partition wall for partitioning between the discharge port and the suction port in the rotating direction is provided on the static flow passage.

The blade casing 4*b* has an annular groove around the rotary shaft 2 as a center, the impeller 4 is arranged in the annular groove of the blade casing 4*b*. The plurality of the blades 4*a* of the impeller 4 are provided crossing the annular groove, in order to section the annular groove in the blade casing 4*b* in the circumferential direction, and the casing 5 is assembled to the blade casing 4*b* so that the static passage 3 is located at a position facing the annular groove.

Figure 2:
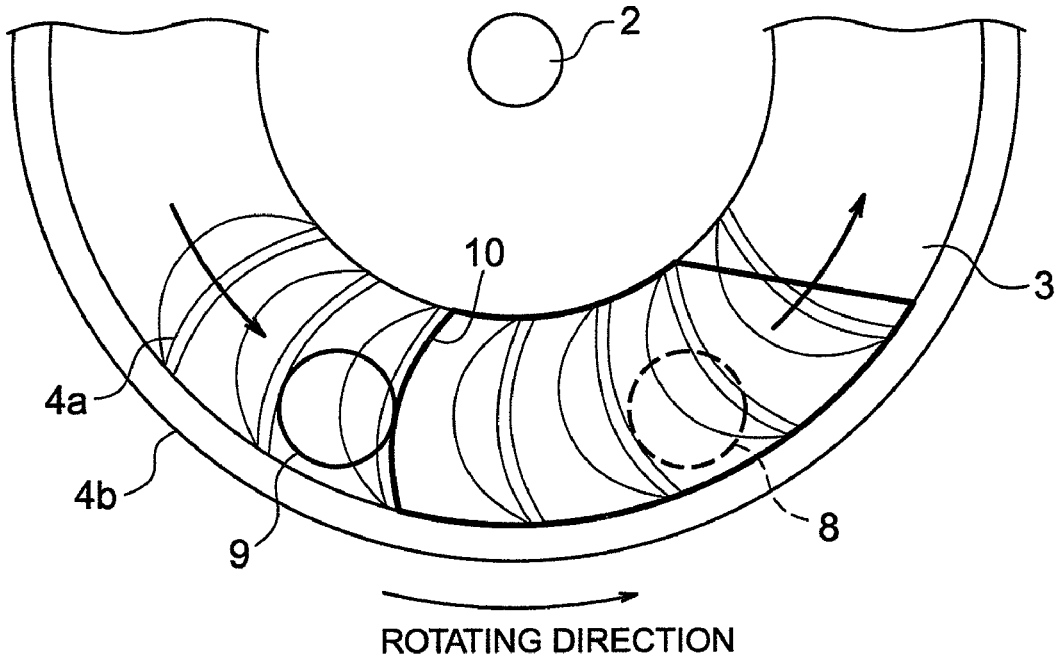
FIG. 2 is a front view illustrating the vortex blower in the condition that a side cover and an impeller being removed therefrom.

Referring to FIG. 2 which is a front view illustrating the vortex blower in this embodiment in the condition that the side cover 6 and the impeller 4 are removed, and in which the blades 4*a* are indicated by thin lines in a phantom-like manger for explaining the positional relationship among the blades 4*a*, the partition wall 10, the discharge port 9 and the suction port 8. The partition wall 10 has, on the discharge side, a shape which is one and the same shape of the blades, having the positional relationship that the partition wall is not overlapped with the discharge port 9 formed on the static passage 3. In this embodiment, the number (partitioning number) of the blades 4*a* accommodated in rear of the partition wall 10 is adjusted so the pressure on the discharge side becomes highest.

Figure 3A:
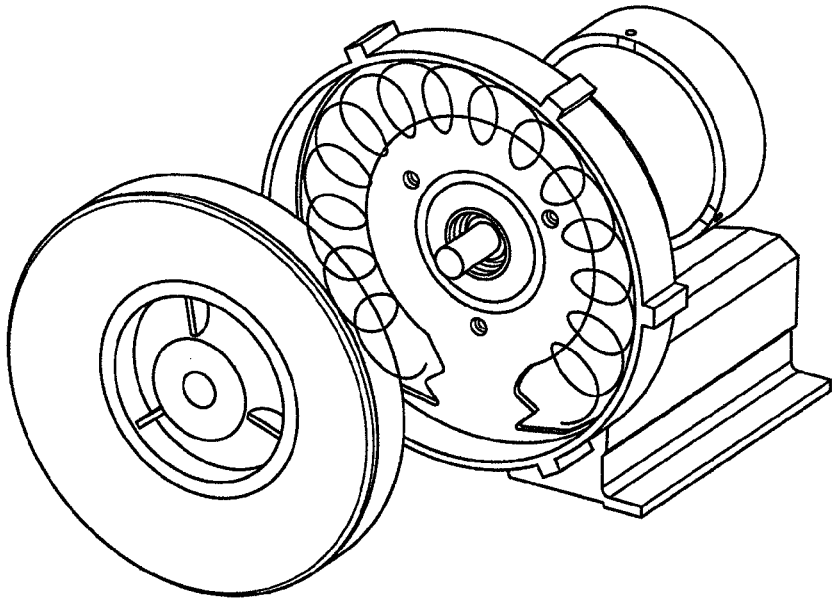
FIG. 3A is a perspective view and FIG. 3B is a front view illustrating the conventional vortex blower in a condition that a side cover and an impeller are removed therefrom.
Figure 3B:
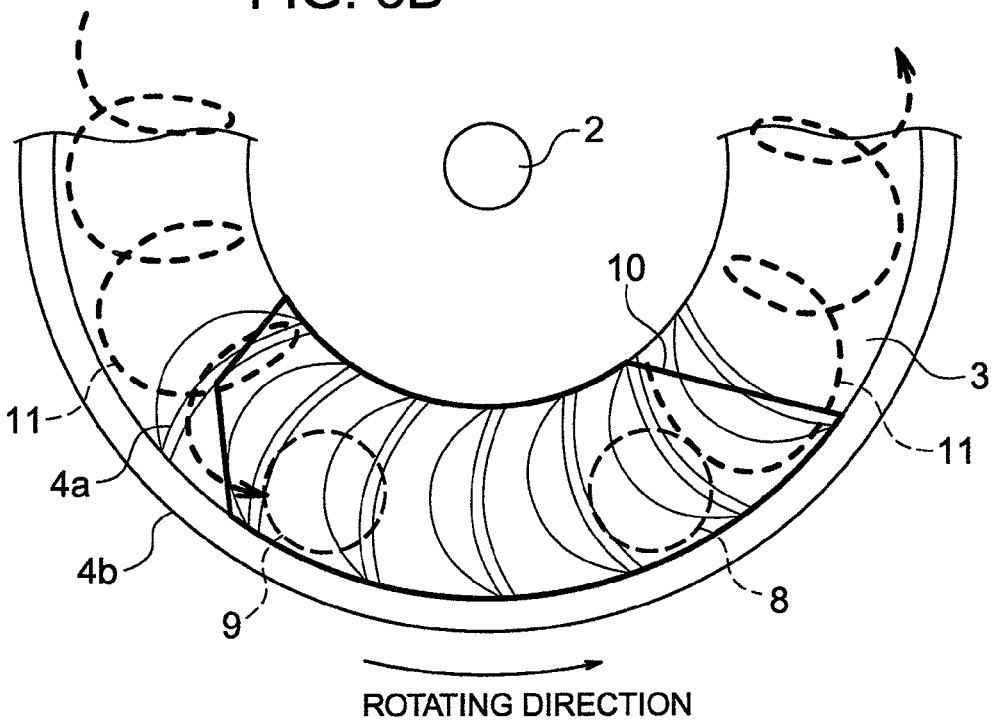

FIG. 3 shows a conventional vortex blower. FIG. 3A is a perspective view. FIG. 3B is a front view. Referring to FIG. 3B, which illustrates a conventional vortex blower in the condition that the side cover 6 and the impeller 4 are removed, and in which blades 4*a* is indicated by thin lines in order to explain the positional relationship among the blades 4*a*, the partition wall 10, the discharge port 9 and the suction port 8. Reference numeral 11 denotes an internal flow. In this embodiment, the shape of the partition wall 10 is as disclosed in the Japanese Patent No. 2680136, the partition wall is provided with guides which are overlapped with suction port 8 and the discharge port 9, provided on the static passage as viewed in front of the vortex blower.

Further, the front end of the guide on the suction side has the shape such that it partitions the blades from the outer peripheral side, and is opened to the static passage 3 from the inner peripheral side. The guide on the discharge side has such the shape that the blades are partitioned from the inner peripheral side of the impeller 4, and accordingly, the stream matches with the velocity distribution of a vortex stream induced between the impeller 4 and the casing 4*b*, thereby it is possible to aim at reducing noises.

Figure 4:
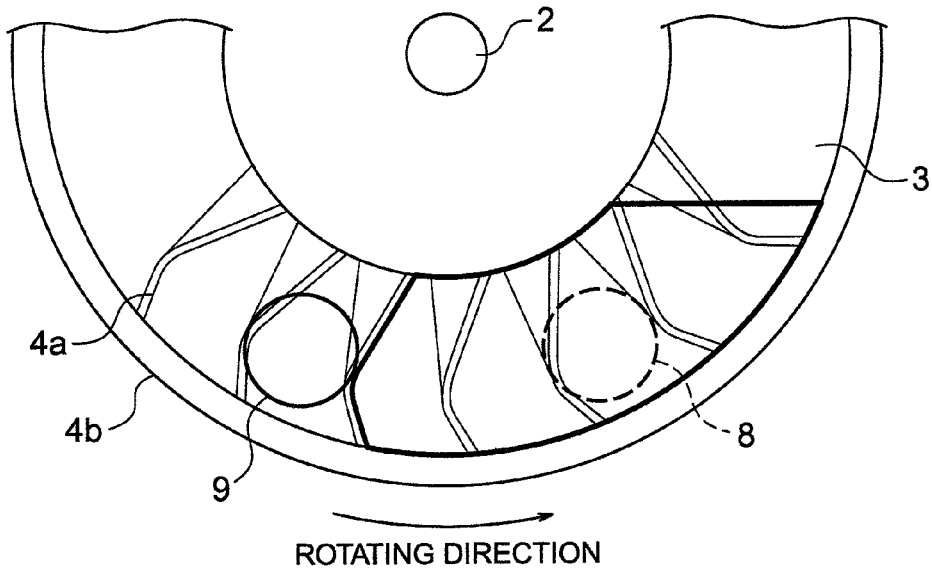
FIG. 4 is a view illustrating another embodiment which is different from the embodiment shown in FIG. 2.

Referring to FIG. 4 which is a front view illustrating a vortex blower in another embodiment in the condition that a side cover 6 and an impeller 4 are removed, and in which blades 4*a* are indicated by thin lines in a phantom-like manner in order to explain the relationship between the blades 4*a* and the partition wall 10, this embodiment is in combination of blades 4*a* having a shape which is different from that of the blades of the impeller 4 which is shown in FIG. 2. The inner peripheral side of the blade is bulged depth-wise in the circumferential direction.

Figure 5:
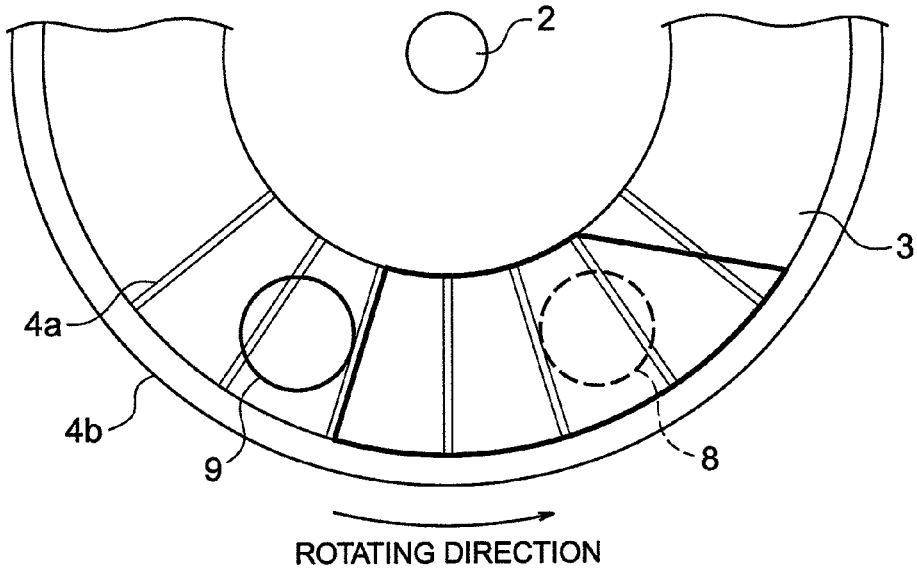
FIG. 5 is a view illustrating another embodiment which is different from the embodiments shown in FIGS. 2 and 4.

FIG. 5 which is a front view illustrating a vortex blower in another embodiment of the present invention in the condition that a side cover 6*b* and an impeller 4 are removed, and in which the blades 4*a* are also indicated by thin lines in a phantom-like manner in order to explain the positional relationship between the blades 4*a* and the partition wall 10, this embodiment is in combination of the blades having a shape which is different from that of the blades in the impellers 4 shown in FIGS. 2 and 4, that is, the shape of the blades is linear in the radial direction.

Figure 6:
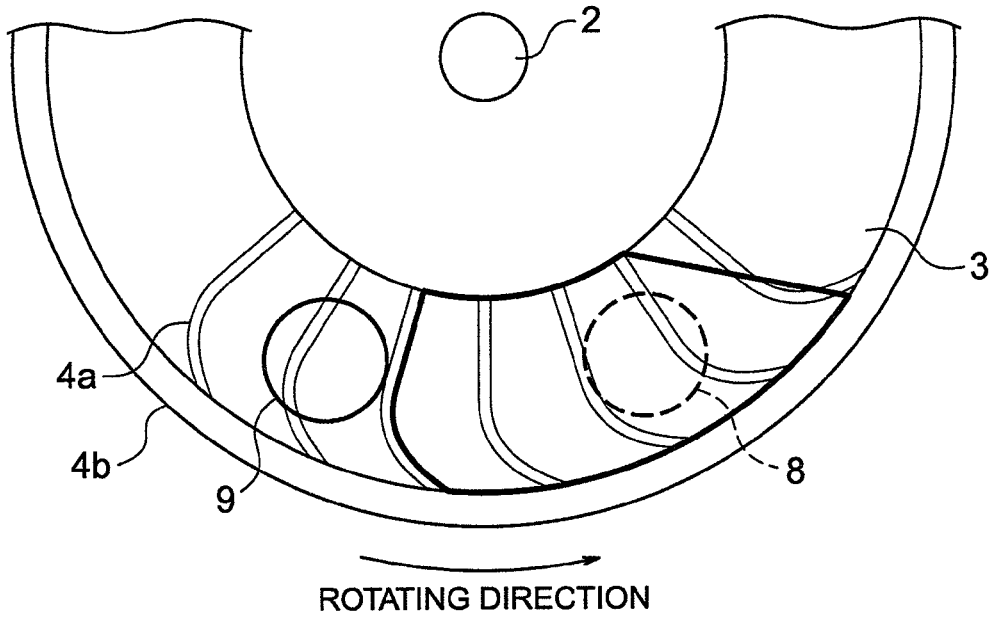
FIG. 6 is a view illustrating another embodiment which is different from the embodiments shown in FIGS. 2, 4 and 5.

FIG. 6 which is a front view illustrating a vortex blower in further another embodiment of the present invention with a side cover 6 and an impeller 4 being removed, and in which the blades 4*a* are indicated by thin lines in a phantom-like manger in order to explain the positional relationship between the blades 4*a* and the partition wall 10. This embodiment is in combination of the blades having a shape which is different from that of the blades of the impeller 4 shown in FIG. 2. That is to say, the shape of the blades is curved but is linear depth-wise without being bulged.

It is the essential feature of the above-mentioned embodiments that the partition wall 10 provided on the static passage 3 to partition between the discharge port 9 and the suction port 8 in the rotating direction, make the discharge side shape corresponding with the shape of the blades 4*a*.

Figure 7:
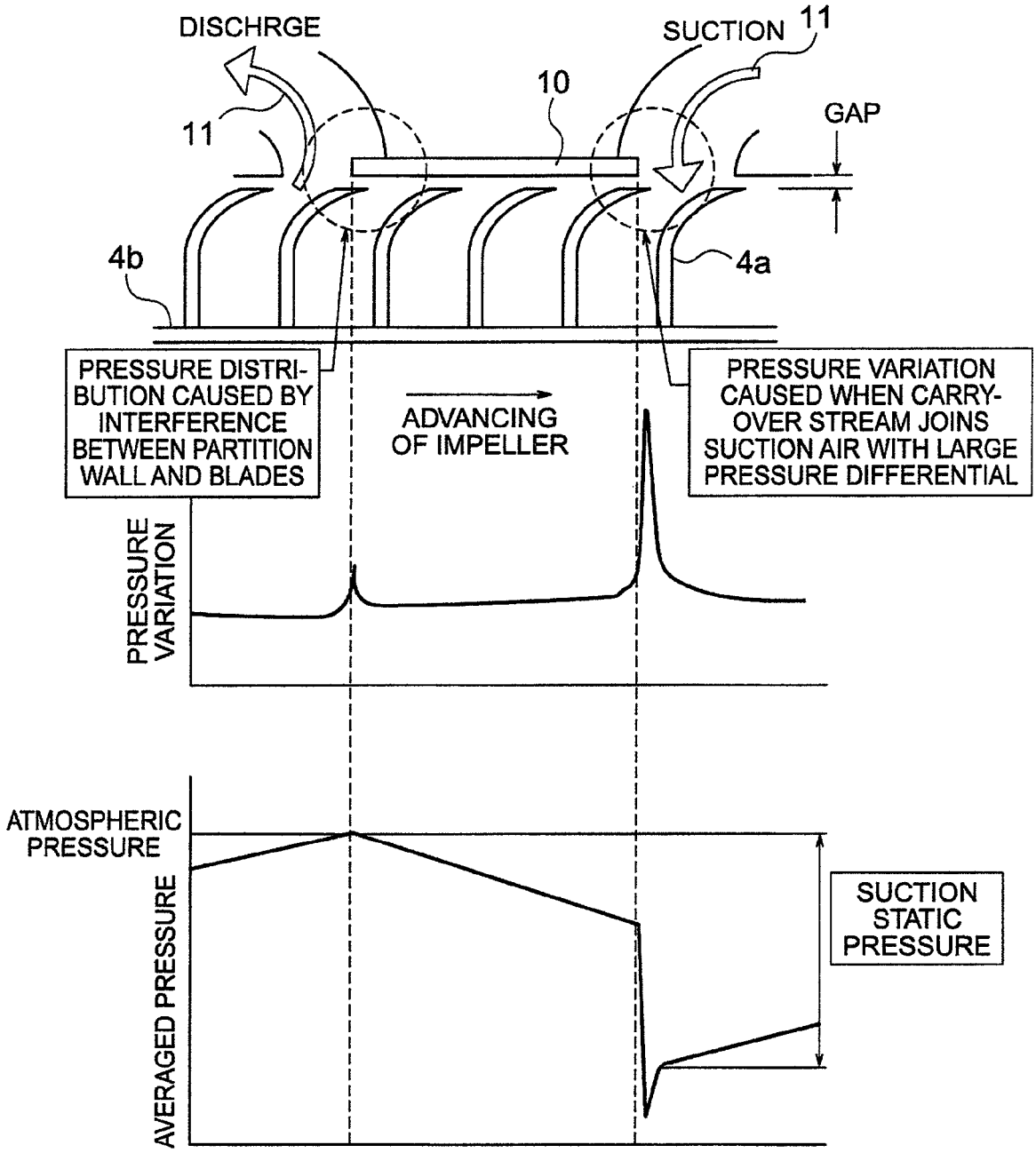
FIG. 7 is an explanatory view for explaining the working of the embodiment.
Figure 8:
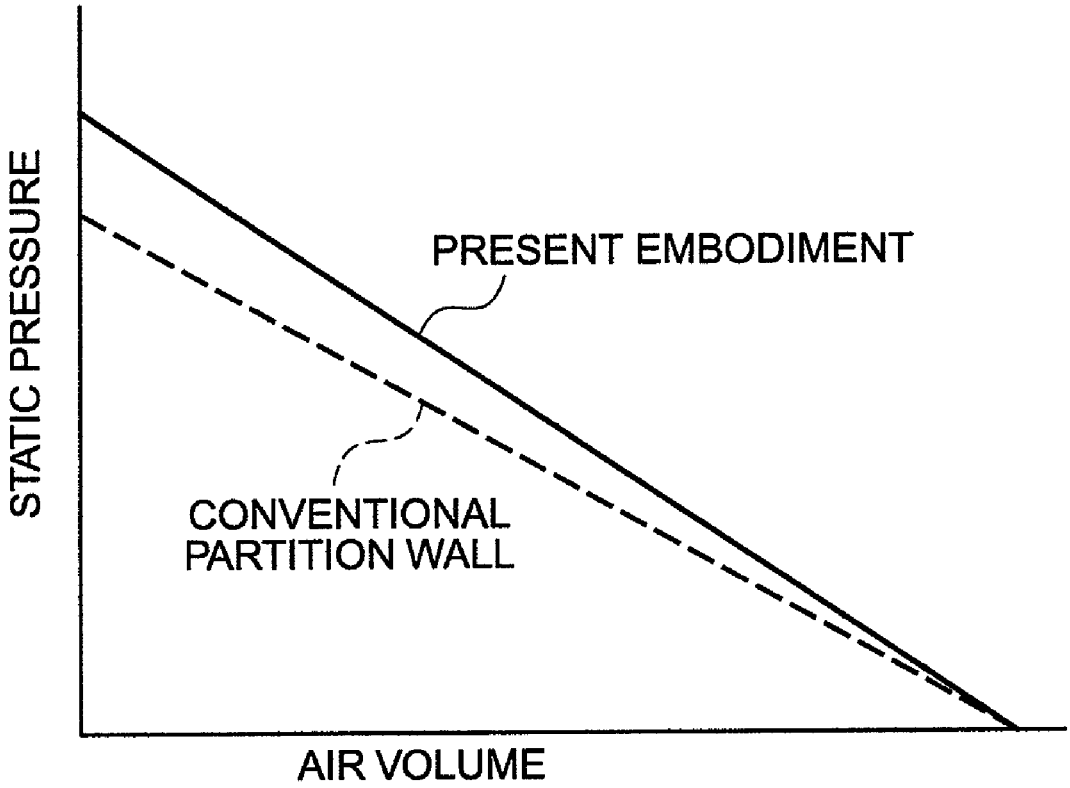
FIG. 8 is a view exhibiting a performance curve of the vortex blower in the embodiment.

FIG. 7 is an explanatory view for explaining the working of the above-mentioned embodiments, and schematically shows the positional relationship between the partition wall 10 and the blades 4*a*, pressures and tendencies of pressure variation at several positions. Further, FIG. 8 is a view illustrating a performance curve of the vortex blower in order to explain the technical effects and advantages of the above-mentioned embodiments.

Explanation will be made of the technical effects and advantages of the above-mentioned embodiments.

As to the pressure rise in the vortex blower, the stream which has been accelerated in the blades 4*a* from the inner periphery to the outer periphery flows into the static passage 3, is then led to the inner peripheral side along the shape of the static passage so as to be decelerated for a pressure rise, and again the stream flows into the blades 4*a* from the inner peripheral side. This process of pressure rise is repeated. As stated above, the action that the stream is swirled so as to whirl the stream is repeated at several times in order to effect a pressure rise, and accordingly, the pressure of the vortex blower is determined by (Pressure Rise per Blade)×(Number of Swirl).

As shown in FIG. 3, the partition wall 10 having the skew shape has been conventionally used for the purpose of reducing noise, and the skew shape extends exceeding the length of the partitioning number of the blades 4*a*. Thus, the suction side and the discharge side are exposed at the same time from the partition wall 10, and accordingly, the static passage becomes shorter, resulting in lowering of the pressure. Moreover, in the example shown in FIG. 3 having the configuration that the suction port 8 and the discharge port 9 are overlapped with the partition wall guides, the stream cannot be smoothly led on the discharge side, it is likely to cause occurrence of a loss.

In general, the leakage flow rate in a gap having a pressure differential, is determined by a size (area) of the gap and the pressure differential across the gap. Specifically, it is proportional to a flow coefficient $\alpha$ which is determined by the shape of the gap, the area A of the gap, and the square root of the pressure differential $\Delta P$, and is exhibited by the following formula (1):

$$\text{Leakage Flow Rate } \Delta G \propto \alpha \times F \times \sqrt{\Delta P} \qquad \text{formula (1)}$$

Referring to FIG. 7 which is a schematic view for explaining the positional relationship between the partition wall 10 and the blades 4*a* in this embodiment, the pressure and the tendency of pressure variation, the blades 4*a* and the partition wall 10 constitute sealing in the partition wall part, that is, a continuous labyrinth seal is formed. Reference numeral 11 denotes an internal flow.

On the suction side, the three blades are partitioned by the partition wall 10 so as to constitute a structure having seals at four positions. Since the leakage flow rates at each of the thus constituted seals are constant due to the mass conservation law, and since the shape of the gaps are identical with each other, in view of formula (1), it is construed that the pressure decreases in a substantially straight line-like manner, and the stream joins at once a stream having a low pressure from the suction port in a part where no partition wall is present on the suction side, resulting in occurrence of pressure variation.

Meanwhile, since the variation is mainly caused by the impingement of the flow rate upon the partition wall, and accordingly, it is construed that the pressure variation on the discharge side is low in comparison with the pressure variation on the suction side, and accordingly, produced sound is low.

In this embodiment, it is assumed that sound produced on the discharge side is low in comparison with that on the suction side, as stated above, and thus, consideration can be made such that the skew of the partition wall is eliminated on the discharge side so as to locate the partition wall at a position where it does not overlap with the discharge port, and a result, the effective length of the static passage is increased in order to increase the number of times of swirling the stream, thereby it is possible to increase the pressure without increasing noises.

In view of the above-mentioned consideration, the inventors eliminate the skew from the shape of the partition wall on the discharge side, make the shape of the partition wall conform with the shape of the blades on the discharge side, and locate the partition wall at a position where the partition wall is prevent from overlapping with the discharge port, and verify the performance. Referring to FIG. 8 which shows the performance curve of the vortex blower in this embodiment, and that of a conventional vortex blower, it is found that a higher pressure can be obtained from the vortex blower in this embodiment, in comparison with the conventional one. Further, it has been concluded that noise level is not changed in comparison with the conventional one.

Since the source of noise in a vortex blower is present on the suction side, it is not necessary to skew the shape of the partition wall on the discharge side and to locate the partition wall at a position where the partition wall overlaps with the discharge port. Thus, by making the shape of the partition wall conform with the shape of the blades, it is possible to obtain a vortex blower having a high pressure with no increased noise.

The invention claimed is:

1. A vortex blower comprising:

a rotary shaft a blade casing having an annular groove around the rotary shaft as a center, an impeller of the vortex blower, incorporating a plurality of blades in the annular groove of the blade casing, the blades crossing the annular groove so as to section the latter in the circumferential direction of the impeller, and a casing formed therein with a static passage opposed to the annular groove, wherein a partition wall partitions between a discharge port and a suction port which are provided on the static passage, having a discharge side shape which is identical with the shape of the blades.

2. A vortex blower as set forth in claim 1, wherein the discharge port provided on the static passage, and the partition wall have a positional relationship in which the partition wall does not overlap with the discharge port.

3. A vortex blower as set forth in claim 1, wherein the shape of the blades is curved as viewed from the rotary shaft.

4. A vortex blower as set forth in claim 2, wherein the shape of the blades is curved as viewed from the rotary shaft.

* * * * *